United States Patent [19]

Blinn

[11] 3,955,773

[45] May 11, 1976

[54] WIRE ROD COILER FOR LARGE BUNDLES OR COILS

[75] Inventor: Franz Blinn, St. Ingbert, Saar, Germany

[73] Assignee: Moeller & Neumann GmbH, St. Ingbert, Saar, Germany

[22] Filed: Dec. 20, 1974

[21] Appl. No.: 535,012

[30] Foreign Application Priority Data

Dec. 24, 1973 Germany ..... 7345736

[52] U.S. Cl. ..... 242/81

[51] Int. Cl.[2] ..... B21C 47/00

[58] Field of Search ..... 242/81, 79

[56] References Cited

UNITED STATES PATENTS

| | | | |
|---|---|---|---|
| 434,190 | 8/1890 | Matteson | 242/81 |
| 451,081 | 4/1891 | Tafro | 242/81 |
| 2,781,179 | 2/1967 | O'Malley | 242/81 |

FOREIGN PATENTS OR APPLICATIONS

| | | | |
|---|---|---|---|
| 673,654 | 11/1964 | Italy | 242/81 |

*Primary Examiner*—Edward J. McCarthy
*Attorney, Agent, or Firm*—John J. Dennemeyer

[57] ABSTRACT

A wire rod coiler for large bundles or coils has a vertically displaceable coiler plate and support structures outwardly limiting the coiling or reeling space. Each support structure guides a flexible member, such as an endless link chain, which is in driven engagement with the coiler plate and which in operation supports outer windings of a bundle or coil being produced to prevent such windings from adhering to the support structures.

2 Claims, 2 Drawing Figures

WIRE ROD COILER FOR LARGE BUNDLES OR COILS

The present invention relates to a wire rod coiler for large bundles or coils, having a coiler plate which can be raised and lowered relatively to the radial limits of the coiling or reeling space and a control arrangement permitting the coiler plate to be lowered during each winding process from a high starting position in synchronism with the increase of height of a bundle or coil being produced.

The invention is suitable for use in a Garrett coiler as well as an Edenborn coiler.

In a wire rod coiler, whether constructed in the form of a Garrett coiler or an Edenborn coiler, the winding of large bundles or coils presents difficulties in as much as during the lowering of the coiler plate the outer windings of the wire bundle or coil tend to adhere to the outer limit of the coiling or reeling space. For example in a Garrett coiler, such adhesion occurs in particular owing to centrifugal force. It is an object of the present invention to avoid this source of trouble.

The invention consists in a wire rod coiler comprising a stationary pan having an upper open end, a circular base plate means rotatably mounted in said pan at the bottom thereof, a plurality of support structures mounted at mutually spaced locations at the periphery of said base plate means and extending upwardly therefrom, said support structures defining the radially outer limit of a coiling or reeling space, a coiler plate means disposed in said coiling or reeling space transverse to said support structures, and driving means for displacing said coiler plate lengthwise of said support structures, wherein each of said support structures supports a flexible, heat-resistant element operatively connected to said coiler plate means for displacement in unison therewith, and wherein said driving means are operable to gradually displace said coiler plate means from a starting position near said open end of said pan towards said base plate means in synchronism with the increase of height of a bundle or coil of wire rod produced in the operation of said coiler, and thereafter to return said coiler plate means to said starting position for ejecting said bundle or coil, said flexible elements being provided for supporting outer windings of said bundle or coil.

Starting from a known wire rod coiler having a coiler plate which is arranged to be raised and lowered relative to the radial limits of the coiling or reeling space which may be defined e.g. by concentric rows of pins, the invention proposes that the coiling or reeling space is limited by vertically displaceable, flexible and heat-resistant elements which are distributed over the radially outer periphery of the coiling or reeling space and against which rest the outer windings of the bundle or coil being formed and which are in driven engagement with the vertically displaceable coiler plate. Owing to this construction the flexible elements are forced to follow the downward movement of the coiler plate and in this manner take the outer windings of the downwardly growing bundle or coil with them.

Preferably the vertically displaceable flexible elements are endless commercially available and highly heat-resistant link chains.

Conveniently the link chains are supported by elongated support members which are inserted in frame members having a substantially U-shaped cross-section and which have rounded top and bottom ends, whereby a construction free of rollers is obtained for guiding and supporting the radially inwardly disposed run of each chain.

One embodiment of the invention as applied to a Garrett type rod coiler is described below by way of example with reference to the accompanying drawings, in which.

Figure 1:
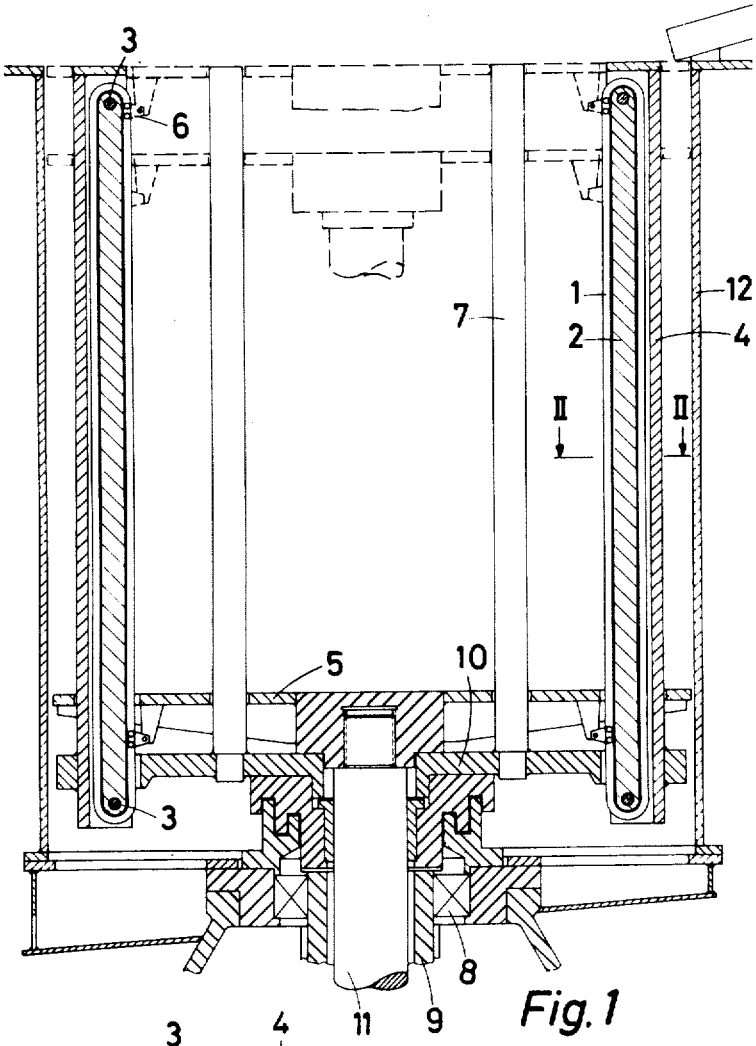
FIG. 1 illustrates a vertical section through the wire rod coiler.

The wire rod coiler illustrated in FIG. 1 is based on the known construction of a Garrett type wire rod coiler and comprises a base plate 10 supporting two rows of concentrically disposed support structures and pins or studs 4 and 7, respectively, defining between them a coiling or reeling space. A bearing 8 for a hollow shaft 9 which is non-rotatably connected to the base plate 10, permits the latter to be rotated during the coiling or reeling process, and a coiler plate 5 is vertically displaceable in a pan 12 surrounding the coiling or reeling space, for the purpose of ejecting a finished bunch or coil and for gradual lowering after the start of each coiling or reeling process.

Figure 2:
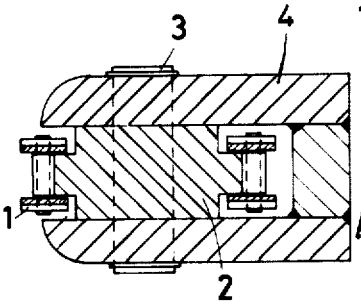
FIG. 2 illustrates a section on the line II — II in FIG. 1, on an enlarged scale.

It may be seen from FIG. 1 in conjunction with FIG. 2 that in the present example the support structures 4 are constructed in the form of elongated frame members of substantially U-shaped cross-section into which are inserted support members 2 which are rounded at the top and bottom ends and which support link chains 1. Each support member 2 is rigidly connected to the respective U-shaped frame member 4 by means of a bolt 3 or other securing means.

Each displaceable link chain 1 is connected to the coiler plate 5 by means of a driver member 6, thereby the chains are positively driven in unison with the coiler plate when the coiler plate is lifted and lowered. Accordingly the chains do not present friction resistance to the outer windings of a downwardly growing bundle or coil.

FIG. 2 illustrates one constructional form envisaged for the U-shaped frame members 4 as well as the support members 2, to provide lateral guidance of the link chains 1 while avoiding the need for providing additional rollers.

What is claimed is:

1. A wire rod coiler comprising a stationary pan having an upper open end, a circular base plate means rotatably mounted in said pan at the bottom thereof, a plurality of support structures mounted at mutually spaced locations at the periphery of said base plate means and extending upwardly therefrom, said support structures defining the radially outer limit of a coiling or reeling space, a coiler plate means disposed in said coiling or reeling space transverse to said support structures, and driving means for displacing said coiler plate lengthwise of said support structures, wherein each of said support structures supports a flexible, heat-resistant element operatively connected to said coiler plate means for displacement in unison therewith, and wherein said driving means are operable to gradually displace said coiler plate means from a starting position near said open end of said pan towards said base plate means in synchronism with the increase of height of a bundle or coil of wire rod produced in the operation of said coiler, and thereafter to return said coiler plate means to said starting position for ejecting said bundle or coil, said flexible elements being provided for contacting outer windings of said bundle or coil.

2. A wire rod coiler according to claim 1, wherein the displaceable elements are endless link chains accommodated in U-shaped elongated frame members which form part of the support structures and into which support members rounded at the top and bottom ends are inserted for supporting the link chains.

* * * * *